US005464356A

United States Patent [19]

Nebeshima et al.

[11] Patent Number: 5,464,356

[45] Date of Patent: Nov. 7, 1995

[54] CONNECTOR

[75] Inventors: Akira Nebeshima; Kaoru Watanabe; Toshikazu Saba, all of Yokkaichi, Japan

[73] Assignee: Sumitomo Wiring Systems, Ltd., Yokkaichi, Japan

[21] Appl. No.: 223,974

[22] Filed: Apr. 6, 1994

[30] Foreign Application Priority Data

Apr. 13, 1993 [JP] Japan ..... 5-04690 U

[51] Int. Cl.[6] ..... H01R 13/514

[52] U.S. Cl. ..... 439/752; 439/733.1

[58] Field of Search ..... 439/595, 752, 439/347, 733

[56] References Cited

U.S. PATENT DOCUMENTS 4,867,711 9/1989 Yuasa ..... 439/752
4,867,712 9/1989 Kato et al. .
5,203,722 4/1993 Kinoshita ..... 439/752 X
5,252,096 10/1993 Okada ..... 439/752

*Primary Examiner*—David L. Pirlot
*Assistant Examiner*—Daniel Wittels
*Attorney, Agent, or Firm*—Oliff & Berridge

[57] ABSTRACT

When a retainer is displaced into a provisionally-retained position, a slanting abutment surface of a retaining step is abutted against a rear edge of a main portion of a metal terminal disposed in a half-inserted position. Then, when the retainer is pushed, each projection is guided by a slanting portion of a guide groove, so that the retainer is displaced obliquely forwardly downwardly, and reaches a completely-retained position. During this displacement, a forwardly-acting pressing force is exerted on the metal terminal, so that the metal terminal is automatically pushed deeper into a proper inserted position.

18 Claims, 6 Drawing Sheets

CONNECTOR

BACKGROUND OF THE INVENTION

This invention relates to a connector having the function of double retaining of metal terminals by a retainer, and more particularly to a connector having the function of urging half-inserted metal terminals into a proper fully-inserted position in accordance with the insertion of the retainer.

There are known connectors having a double retaining function to be performed by a retainer. In such a connector as shown in FIG. 7, when a metal terminal c is inserted into a terminal receiving hole b in a housing a from a rear end thereof, an elastic retaining pawl d formed on an upper wall of the terminal receiving hole b is elastically deformed by this inserted metal terminal. Then, when the metal terminal reaches a fully-inserted position at the inner end of the terminal receiving hole, the retaining pawl d is received in a retaining recess e, formed in the upper surface of the metal terminal c, due to its own resilient restoring force, thereby effecting a first-stage retaining in a withdrawing direction. Then, when a retainer f, inserted into a provisionally-retained position from a lower side of the housing a in a manner to generally divide the housing, is pushed in a direction of an arrow to be retained in a completely-retained position, a retaining step a formed on the retainer f is received in a recess h formed in a lower surface of the metal terminal c, thereby effecting a second-stage retaining.

In such a connector, the metal terminal c is inserted while elastically deforming the retaining pawl d, as described above, and therefore a considerable load is perceived half-way, and despite the fact that the metal terminal has not yet reached the fully-inserted position, the inserting operation is often stopped under a mistake of facts in a partially-inserted position as indicated in a broken line in FIG. 7.

If such a situation is encountered, even when the retainer f is pushed, the retaining step q is abutted against the lower surface of the metal terminal c, so that the retainer can not be inserted. In this case, the operator becomes aware of the partially-inserted condition of the metal terminal c, and it is necessary for the operator to once retract the retainer f, to re-insert the metal terminal c into the fully-inserted position, and then to again push the retainer f. However, since many metal terminals c have been inserted, it is not easy to find the partially-inserted terminal among these terminals. And besides, such partially-inserted metal terminal is not always one, and in an extreme case, all of the metal terminals must be re-inserted, thus inviting a disadvantage that an extremely troublesome operation must be done.

It is known from experiences that the metal terminal c is held in the partially-inserted condition mainly because the retaining step q of the retainer f interferes with an end edge of a main portion i.

SUMMARY OF THE INVENTION

The present invention has been made in view of the above problem, and an object of the invention is to correct a partially-inserted condition of a metal terminal, thereby enabling mating connectors to be easily fitted together.

One object of the present invention has been achieved by a connector comprising a housing having terminal receiving holes each for receiving a metal terminal inserted from a rear end thereof; a retainer insertable into a retainer insertion groove which is formed in the housing in a manner to generally divide each of the terminal receiving holes, and is open to one side of the housing, the retainer having communication holes communicatable with the terminal receiving holes, respectively, and the retainer being adapted to be retained in a provisionally-retained position where each of the communication holes does not hinder the insertion and withdrawal of the metal terminal and in a completely-retained position where the retainer is engaged with the metal terminals in a manner to limit the withdrawal of the metal terminals; wherein guide grooves for guiding the insertion of the retainer are formed respectively in those surfaces of one of the housing and the retainer facing the other, whereas projections for being displaced respectively along the guide grooves are formed on the other; the retainer can be abutted against part of the metal terminal in the provisionally-retained position when the metal terminal is disposed in a partially-inserted position; and each of the guide grooves is so formed that during the time when the retainer is displaced from the provisionally-retained position to the completely-retained position, the retainer can push the metal terminals from the partially-inserted position into a fully-inserted position.

When the retainer is inserted into the retainer insertion groove in the housing, the retainer reaches the provisionally-retained position, with the projections guided by and moved along the guide grooves, respectively. The metal terminals are inserted, and then when the retainer is further inserted, the retainer is displaced to the completely-retained position. If the metal terminal is disposed in a partially-inserted position during the displacement of the retainer from the provisionally-retained position, the retainer is abutted against part of the metal terminal, and pushes the metal terminal into a fully-inserted position during the displacement of the retainer into the completely-retained position, and also the retainer retains the metal terminals against withdrawal in this position.

Advantageous effects of the present invention will be described. Even if the metal terminal is inadvertently disposed in a partially-inserted position, the metal terminal can be automatically pushed into the fully-inserted position in accordance with the displacement of the retainer from the provisionally-retained position into the completely-retained position. Thus, there is no need to re-insert the metal terminal, and therefore the efficiency of the operation can be enhanced greatly.

DETAILED DESCRIPTION OF PREFERRED EMBODIMENTS

Figure 1:
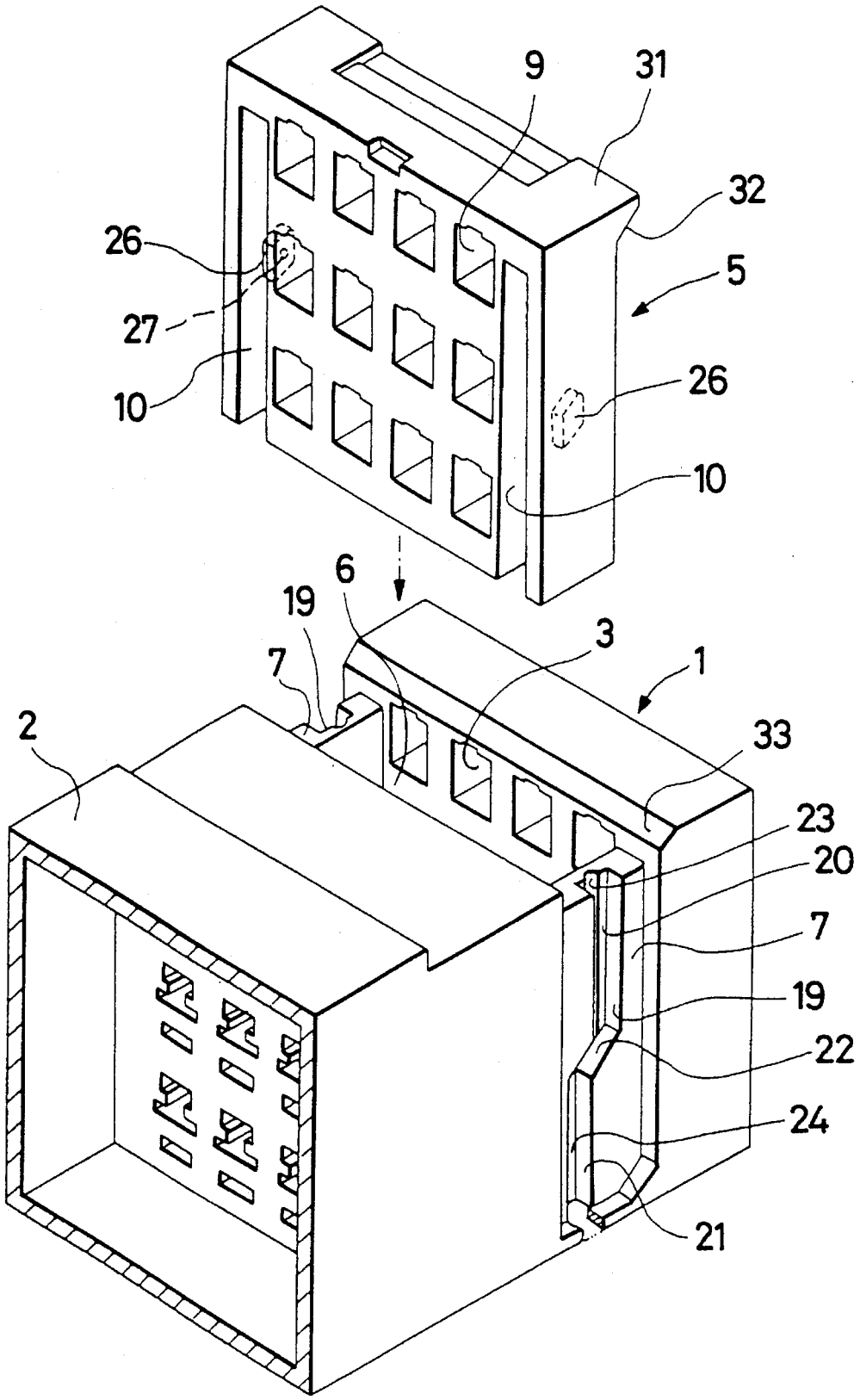
FIG. 1 is a partly-broken, exploded perspective view of one preferred embodiment of the present invention.

One preferred embodiment of the present invention, in which the invention is applied to a male connector, will now be described with reference to FIGS. 1 to 5.

In these Figures, a housing 1 includes a body 2 of a rectangular parallelepipedic shape, and twelve (12) terminal receiving holes 3 for respectively receiving male metal terminals 11 are formed through this body, and extend from a front side to a rear side of the housing, the terminal receiving holes 3 being arranged in three columns and four rows. A retainer insertion groove 6 for receiving a retainer 5 for retaining the metal terminals 11 in a double manner is formed in a generally central portion of an upper surface of the body 2 in a manner to divide each terminal receiving hole 3, and guide walls 7 are provided respectively on opposite (right and left) sides of this retainer insertion groove.

Communication holes 9 equal in number to the terminal receiving holes 3 are formed through the retainer 5, and are communicatable with the terminal receiving holes 3, respectively. Formed respectively in opposite (right and left) sides of the retainer are downwardly-open fitting grooves 10 in which the guide walls 7 are adapted to be fitted, respectively.

Figure 3:
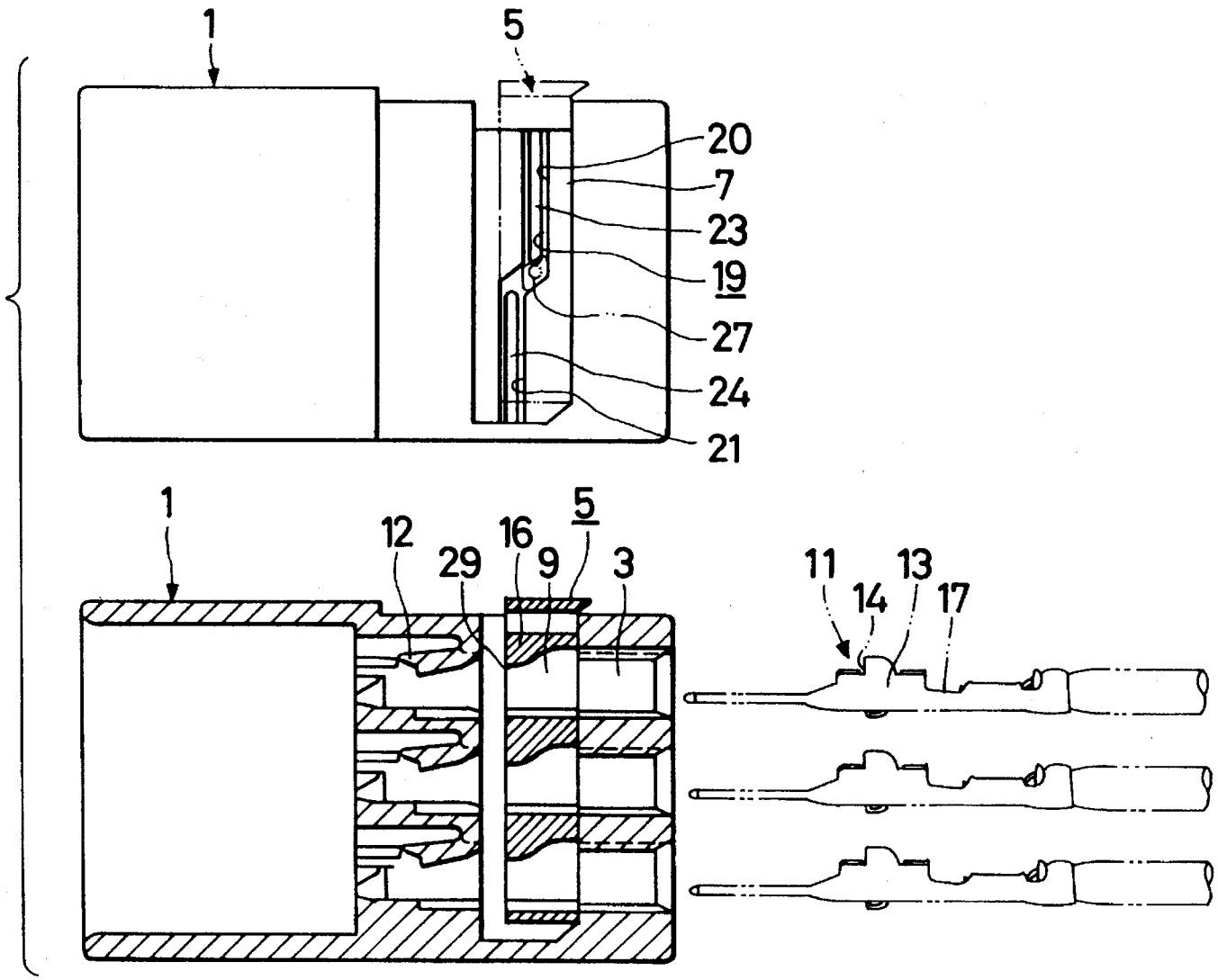
FIG. 3 is an explanatory view showing a condition in which the retainer is inserted to a position immediately before a provisionally-retained position.

The retainer 5 is inserted into a predetermined position in the retainer insertion groove 6, with the two fitting grooves 10 fitted respectively on the guide walls 7, as shown in FIG. 3, and then the metal terminals 11 are respectively inserted into the terminal receiving holes 3, and are pushed to inner ends thereof, so that an elastic retaining pawl 12 (see FIG. 3) formed within each receiving hole 3 is received in a retaining recess 14 formed in an upper surface of a main portion 13 of the metal terminal 11, thereby effecting a first-stage retaining in a withdrawing direction. When the retainer 5 is further pushed, a retaining step 16, formed on an upper wall of each communication hole 9, is received in a recess 17 formed adjacent to a rear end of the main portion 13, thereby effecting a second-stage retaining, as described above for the conventional construction.

Next, the structure of the insertion portion of the retainer 5 of the present invention will now be described in detail.

In this embodiment, the thickness of the retainer 5 is smaller by a predetermined dimension than the width of the retainer insertion groove 6.

Figure 2:
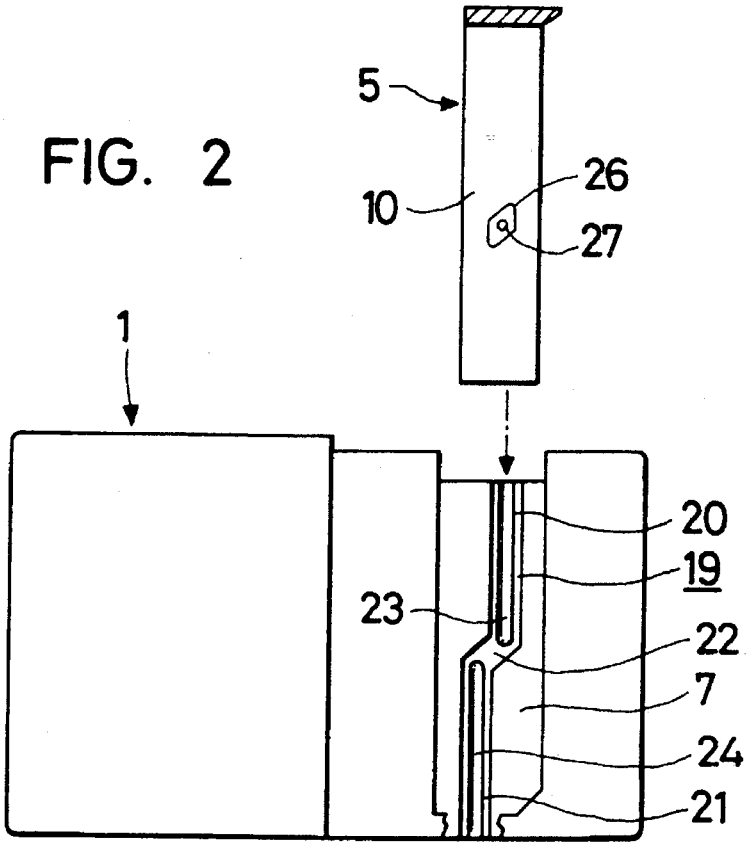
FIG. 2 is a front-elevational view showing a housing and a retainer before they are assembled together.

A generally vertically-extending guide groove 19 for guiding the insertion of the-retainer is formed in an outer surface of each of the guide walls 7 formed respectively on the opposite (right and left) sides of the retainer insertion groove 6. As shown in FIG. 2, the guide groove 19 has an upper straight portion 20 and a lower straight portion 21 which are parallel to each other, and are offset relative to each other in a front-to-rear direction in such a manner that inner edges of the two straight portions are disposed in a common straight line. This configuration is achieved by a mold of a special design for forming the two straight portions 20 and 21, and this will be described later in detail. The lower end of the upper straight portion 20 is connected to the upper end of the lower straight portion 21 by a slanting portion 22 slanting toward the front side. An auxiliary groove 23 of a greater depth is formed in the straight portion 20, and is disposed centrally of the width thereof, and extends from the upper end thereof to the slanting portion 22. An auxiliary groove 24 of a greater depth is formed in the straight portion 21, and is disposed centrally of the width thereof, and extends from the lower end thereof to the slanting portion 22. Each of the grooves 23 and 24 has a semi-circular cross-section, and has the end formed into a semi-spherical shape. The lower end of the auxiliary groove 23 and the upper end of the auxiliary groove 24 are separated from each other, unlike the guide groove 19.

On the other hand, a projection 26 of a parallelogrammic shape is formed on that surface of each of the right and left fitting grooves 10 of the retainer 5 facing that surface of the guide wall 7 having the guide groove 19 formed therein, and the projection 26 is formed at a predetermined position, and can be intimately fitted in and slide along the straight portions 20 and 21 and the slanting portion 22 of the guide groove 19. Further, a projection 27 of a semi-spherical shape for fitting in the auxiliary groove 23, 24 is formed on the surface of the projection 26.

With respect to the guide groove 19, the lower straight portion 21 is not always necessary in view of the function of this embodiment described later in detail, and also the auxiliary groove 24 may be replaced by a semi-spherical hole for receiving the projection 27 which hole is formed at the position where the upper end of the lower auxiliary groove 24 is disposed. Furthermore, it is not necessary that the inner edges of the two straight portions 20 and 21 should be disposed in a common straight line, and this configuration is adopted for the convenience of the formation of the guide groove 19 by molding.

Figure 5:
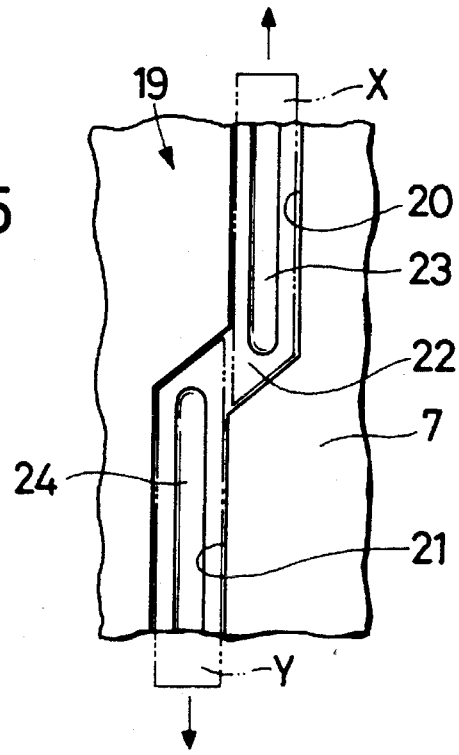
FIG. 5 is a view explanatory of the formation of a guide groove by molding.

More specifically, for forming the guide groove 19 by molding, a pair of upper and lower slide cores x and y each having an inclined front end are used, as shown in FIG. 5, and the cores x and y serve to form the upper and lower straight portions 20 and 21, respectively, and also serve to form halves of the slanting portion 22, respectively. Merely by withdrawing the upper and lower cores x and y in directions of arrows, respectively, the upper and lower straight portions 20 and 21 and the slanting portion 22 are simultaneously formed by molding. Namely, the removal of a mold portion in a direction away from the front surface of the sheet of FIG. 5 is omitted, thereby reducing the manufacturing cost.

The front edge of the retaining step 16, formed on the upper wall of each communication hole 9 in the retainer 5, is cut to form a slanting abutment surface 29 which allows a smooth pushing of the metal terminal 11.

The operation of this embodiment will now be described mainly with reference to FIGS. 3 and 4.

First, the retainer 5 is brought into registry with a rear portion of the retainer insertion groove 6, and is inserted thereinto. At this time, each projection 26 and each projection 27 of the retainer 5 are fitted respectively in the upper straight portion 20 of the guide groove 9 and the auxiliary groove 23 during the insertion, and the retainer is inserted straight downward while guided by these portions. When each projection 26 and each projection 27 reach the lower ends of the upper straight portion 20 and the auxiliary groove 23, respectively, a resistance is perceived, and the insertion operation is stopped once, so that the retainer 5 is stopped at a position slightly before a provisionally-retained position. In this condition, the metal terminals 11 are inserted into the terminal receiving holes 3 of the housing 1, respectively, as described above.

Figure 4B:
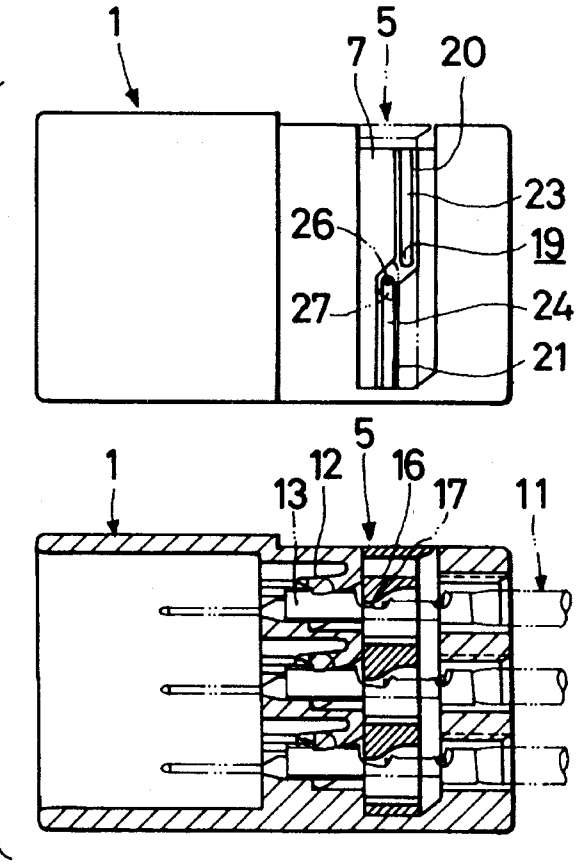
FIG. 4B is an explanatory view showing the retainer in a completely-retained position.
Figure 4A:
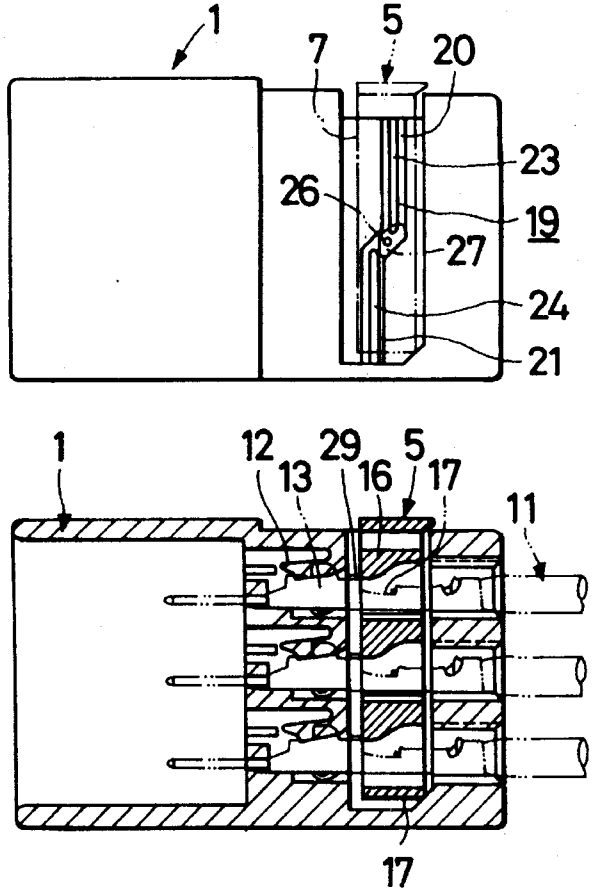
FIG. 4A is an explanatory view showing the retainer in the provisionally-retained position.

Then, when the retainer 5 is further pushed, the projection 27 is disengaged from the lower end of the auxiliary groove 23, and is brought into contact with the bottom surface of the slanting portion 22 of the guide groove 19 as shown in FIG. 4A, and the projection 26 is guided along this slanting portion 22, so that the retainer 5 is slightly displaced obliquely forwardly downwardly to reach the provisionally-retained position.

In this provisionally-retained position, the projection 27 is held in contact with the bottom surface of the guide groove 19, as described above, and therefore because of a frictional engagement between the two, for example, when transporting a provisionally-assembled structure comprising the housing 1, the retainer 5 and the metal terminals 11, the retainer 5 will not be easily disengaged, and also the retainer 5 will be effectively prevented from being accidentally displaced into a completely-retained position.

If any of the metal terminals 11 has not yet reached the fully-inserted position, and hence is disposed in a partially-inserted position when the retainer 5 is displaced into the above provisionally-retained position, the slanting abutment surface 29 on the front edge of the retaining step 16 of the retainer 5 is abutted against a rear edge of the main portion 13 of the metal terminal 11 disposed adjacent to the recess 17, as shown in FIG. 4A.

In this condition, when the retainer 5 is further pushed, the projection 26 is guided by the remaining portion of the slanting portion 22, and the retainer 5 is further displaced obliquely forwardly downwardly, so that the retainer 5 is abutted at its lower surface against the bottom surface of the retainer insertion groove 6, and hence reaches the completely-retained position, thus stopping the displacement, as shown in FIG. 4B. At this time, the projection 27 is fitted in the upper end of the lower auxiliary groove 24, thereby retaining the retainer 5 against upward movement.

During the time when the retainer 5 is displaced obliquely forwardly downwardly from the provisionally-retained position to the completely-retained position, the metal terminal 11 receives a forwardly-acting pressing force to be pushed into the fully-inserted position, so that the first-stage retaining by the elastic retaining pawl 12 is effected, and also the retaining step 16 of the retainer 15 is fitted in the recess 17, thereby effecting the second-stage retaining.

Thus, in this embodiment, even if the metal terminal 11 is inadvertently held in a partially-inserted position, the metal terminal can be automatically pushed into the fully-inserted position in accordance with the displacement of the retainer 5 from the provisionally-retained position to the completely-retained position, and therefore there is no need to re-insert the metal terminal 11.

In the structure of this embodiment, by bringing each projection 27 of the retainer 5 into contact with the bottom surface of the slanting portion 22 of the guide groove 19, the retainer 5 can be easily locked in the provisionally-retained position in such a manner that the retainer can not be displaced upwardly and downwardly. Also, by fitting the projection 27 in the upper end of the lower auxiliary groove 24, the retainer can be held in the completely-locked position against upward movement.

In order to confirm the direction of the retainer 5, forwardly downwardly-slanting surfaces 32 and 33, which are parallel to the slanting portion 22 of the guide groove 19, and can be mated with each other, may be formed on a lower surface of a projected portion 31 formed on the upper rear edge of the retainer 5 and the upper rear edge of the retainer insertion groove 6, respectively, in which case in addition to the fitting of the projection 26 in the slanting portion 22 of the guide groove 19, a relative sliding movement between the slanting surfaces 32 and 33 serves to guide the oblique displacement of the retainer 5.

Figure 6B:
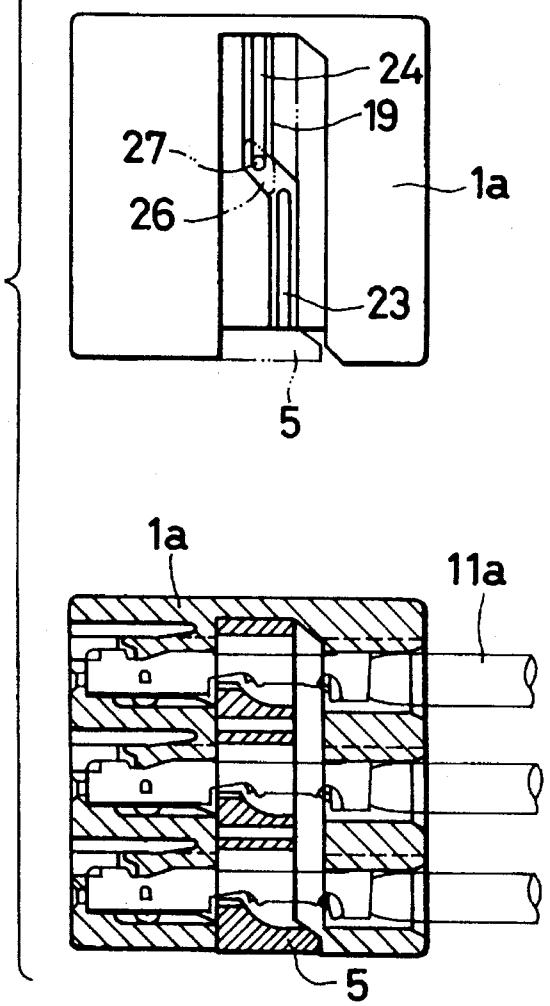
FIG. 6B is an explanatory view of the female connector, showing the retainer in a completely-retained position.
Figure 6A:
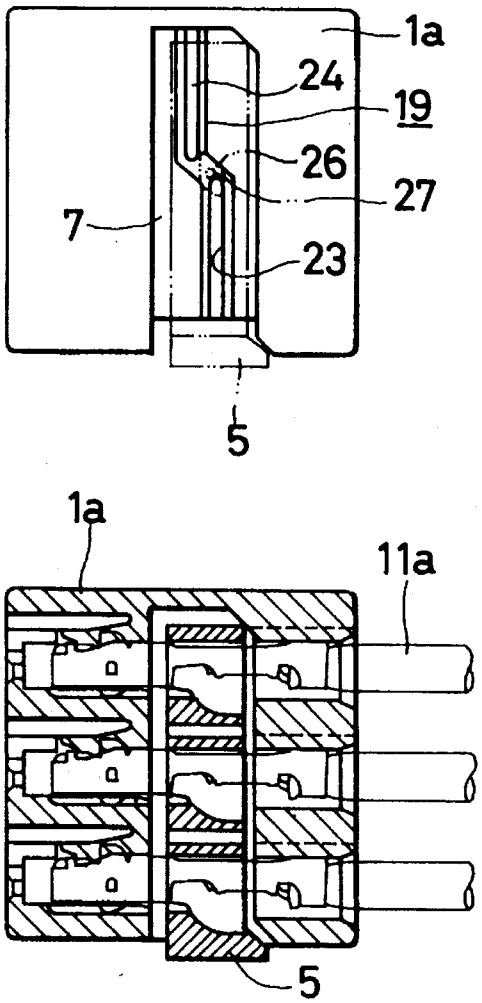
FIG. 6A is an explanatory view of another embodiment of the present invention in which the invention is applied to a female connector, showing a retainer in a provisionally-retained position.
Figure 7:
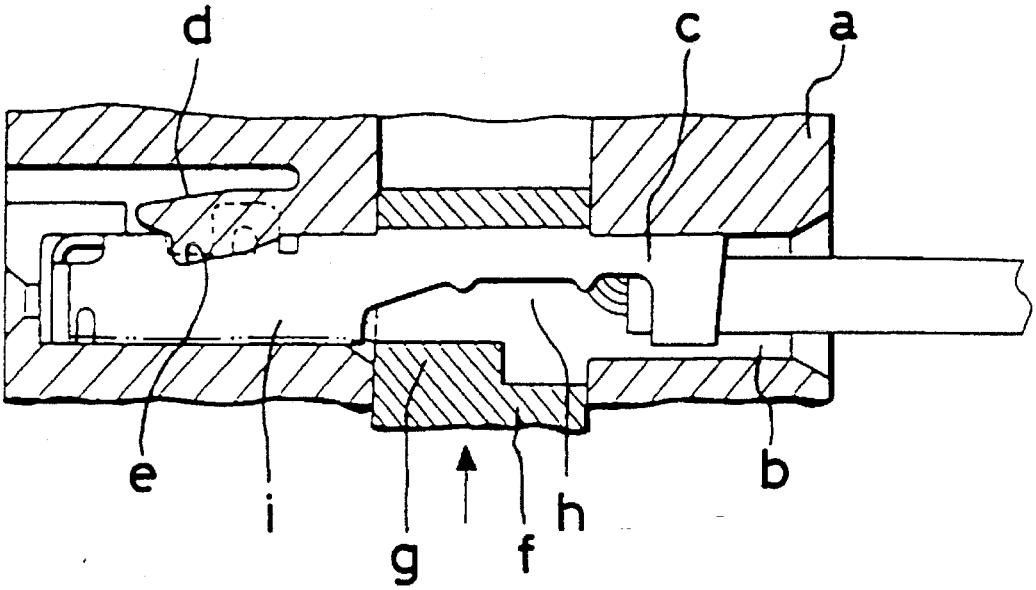
FIG. 7 RELATED ART
FIG. 7 is a cross-sectional view of a portion of a conventional construction.

In the above embodiment, although the invention is applied to the male connector, the invention can be applied to a female connector, as shown in FIG. 6. In this case, similarly, a guide groove 19 and auxiliary grooves 23 and 24 are formed in each of two guide walls 7 provided respectively at opposite sides of a retainer insertion groove 6 in a housing la, and a projection 26 and a projection 27 are formed on that surface of each fitting groove 10 of the retainer 5 facing the guide wall. With this arrangement, during the time when the retainer 5 is 10 displaced from a provisionally-retained position (FIG. 6A) to a completely-retained position (FIG. 6B), those metal terminals 11*a* disposed in a partially-inserted position can be pushed into a fully-inserted position, as described above.

Of course, in either of the above connectors, the guide groove 19 and the auxiliary grooves 23 and 24 may be provided at each fitting groove 10 of the retainer whereas, the projection 26 and the projection 27 may be formed on that surface of the guide wall 7 of the retainer insertion groove 6 facing these grooves.

What is claimed is:

1. A connector comprising:

a housing having a first upper surface and including a body having at least one terminal receiving hole for receiving a metal terminal, said housing further including guide walls between which a retainer insertion groove is located, each of said guide walls including one of a guide groove and a guide projection; and a retainer having a second upper surface and including at least one communication hole for communication with said at least one terminal receiving hole, said retainer having the other of said guide groove and said guide projection, said guide groove and said guide projection being cooperable for guiding the insertion of said retainer into said retainer insertion groove, wherein:

said retainer is retained in a provisionally-retained position in said retainer insertion groove when said metal terminal is inserted in a partially-inserted position, said retainer is retained in a completely-retained position in said retainer insertion groove when said retainer is moved from said provisionally-retained position to a completely-retained position thereby pushing the metal terminal from said partially-inserted position to a fully-inserted position, and said first upper surface and said second upper surface are substantially continuous and flush when said retainer is in the completely-retained position.

2. A connector as claimed in claim 1, wherein said retainer has two leg portion to form fitting grooves downwardly opened to be fitted with said guide walls.

3. A connector as claimed in claim 2, wherein said guide grooves are formed on said guide walls, and said projections are formed on said leg portions.

4. A connector as claimed in claim 1, wherein a width of said retainer is less than a width of said retainer insertion groove by a predetermined width.

5. A connector as claimed in claim 4, wherein said retainer further includes a projected portion having a width substantially equal to a width of said retainer insertion groove, said second upper surface being formed on said projected portion.

6. A connector as claimed in claim 5, wherein said projected portion further includes a first downwardly slanted surface that cooperates with a second downwardly slanted surface on said housing to push said retainer from said provisionally-retained position to said completely-retained position.

7. A connector as claimed in claim 5, wherein the difference between said retainer width and said retainer insertion groove width is substantially equal to a movement distance when said retainer is moved from said provisionally-retained position to said completely-retained position.

8. A connector as claimed in claim 1, wherein each guide groove further includes an auxiliary groove of greater depth and located at the center of the width of the guide groove.

9. A connector as claimed in claim 8, wherein each projection has a semi-spherical projection for fitting with each auxiliary groove.

10. A connector as claimed in claim 1, wherein each of said guide groves for guiding said projection has an upper straight portion and a lower straight portion which are parallel to and offset relative to each other in front-to-rear direction in a manner that inner edges of the two straight portions are aligned in a common straight line, and a slanting portion communicating said upper and lower straight portions.

11. A connector as claimed in claim 10, wherein said projection has a parallelogrammic shape, a pair of sides of which contact with edges of each straight portion of the guide groove, and the other pair of sides contact with edges of the slanting portion.

12. A connector comprising:

a housing including a body having at least one terminal receiving hole for receiving a metal terminal inserted into said at least one terminal receiving hole, said housing further including guide walls between which a retainer insertion groove is located, each guide wall including one of a guide groove and a guide projection; and a retainer including at least one communication hole for communication with said at least one terminal receiving hole, said retainer further including a main portion and a leg portion formed adjacent each side of said main portion, said main portion being spaced from each of said leg portions to form fitting grooves for each of said guide walls, each of said leg portions including the other of the guide groove and the guide projection, said guide groove and said guide projection being cooperable for guiding the insertion of said retainer into said retainer insertion groove.

13. A connector as claimed in claim 12, wherein each of said guide grooves for guiding said projection has an upper straight portion and a lower straight portion which are parallel to and offset relative to each other in front-to-rear direction in a manner that inner edges of the two straight portions are aligned in a common straight line, and a slanting portion communicating said upper and lower straight portions.

14. A connector as claimed in claim 13, wherein said projection has a parallelogrammic shape, a pair of sides of which contact with edges of each straight portion of the guide groove, and the other pair of sides contact with edges of the slanting portion.

15. A connector as claimed in claim 12, wherein each guide groove further includes an auxiliary groove of greater depth and located at the center of the width of the guide groove.

16. A connector as claimed in claim 15, wherein each projection further includes a semi-spherical projection for fitting with each auxiliary groove.

17. A method for connecting a metal terminal, comprising the steps of:

providing a housing having a first upper surface;

inserting the metal terminal in the housing to a partially-inserted position;

inserting a retainer having a second upper surface in a retainer insertion groove to a provisionally-retained position;

moving the metal terminal from said partially-inserted position to a fully-inserted position by pushing said retainer from the provisionally-retained position to a completely-retained position; and forming a substantially continuous and flush first upper surface and second upper surface.

18. The method of claim 17, wherein said moving step comprises moving said retainer in a direction that is substantially perpendicular to a direction of movement of the metal terminal.

* * * * *